US007261808B2

(12) United States Patent
Grandvallet et al.

(10) Patent No.: US 7,261,808 B2
(45) Date of Patent: Aug. 28, 2007

(54) UPGRADING OF PRE-PROCESSED USED OILS

(75) Inventors: Pierre Grandvallet, Amsterdam (NL); Anthony Patrick Hagan, Amsterdam (NL); Laurent Georges Huve, Amsterdam (NL)

(73) Assignee: Shell Oil Company, Houston, TX (US)

( * ) Notice: Subject to any disclaimer, the term of this patent is extended or adjusted under 35 U.S.C. 154(b) by 397 days.

(21) Appl. No.: 10/492,720

(22) PCT Filed: Oct. 16, 2002

(86) PCT No.: PCT/EP02/11609

§ 371 (c)(1),
(2), (4) Date: Apr. 15, 2004

(87) PCT Pub. No.: WO03/033630

PCT Pub. Date: Apr. 24, 2003

(65) Prior Publication Data

US 2005/0006282 A1 Jan. 13, 2005

(30) Foreign Application Priority Data

Oct. 16, 2001 (EP) ..... 01402663

(51) Int. Cl.
*C01M 175/02* (2006.01)
*C10G 65/02* (2006.01)

(52) U.S. Cl. ..... 208/179; 208/28; 208/59; 208/211; 208/212; 208/251 H

(58) Field of Classification Search ..... 208/28, 208/59, 179, 211, 212, 251 H
See application file for complete search history.

(56) References Cited

U.S. PATENT DOCUMENTS

| | | | | |
|---|---|---|---|---|
| 3,980,551 | A * | 9/1976 | Wolk | 208/179 |
| 4,265,734 | A | 5/1981 | Wielezynsi | 208/180 |
| 4,297,242 | A | 10/1981 | Hensley, Jr. et al. | 252/439 |
| 4,376,040 | A | 3/1983 | Sader | 208/180 |
| 4,490,245 | A | 12/1984 | Mead et al. | 208/179 |
| 4,574,043 | A | 3/1986 | Chester et al. | 208/59 |
| 4,606,815 | A | 8/1986 | Gibson | 208/210 |
| 4,613,425 | A | 9/1986 | Higashi et al. | 208/89 |
| 4,681,674 | A * | 7/1987 | Graven et al. | 208/59 |
| 5,053,373 | A | 10/1991 | Zones | 502/64 |

(Continued)

FOREIGN PATENT DOCUMENTS

CA 2068905 11/1993

(Continued)

OTHER PUBLICATIONS

International Search Reported mailed Jan. 30, 2003.

*Primary Examiner*—Glenn Caldarola
*Assistant Examiner*—Prem C Singh
(74) *Attorney, Agent, or Firm*—Charles W. Stewart

(57) ABSTRACT

A process to further upgrade a pre-processed used lubricating oil by:
(a) contacting the partially upgraded used oil in the presence of hydrogen with a hydrodemetallization catalyst;
(b) contacting the effluent of step (a) in the presence of hydrogen with a hydrotreating catalyst;
(c) contacting the effluent of step (b) in the presence of hydrogen with a dewaxing catalyst; and
(d) contacting the effluent of step (c) in the presence of hydrogen with a hydrotreating catalyst.

41 Claims, 1 Drawing Sheet

U.S. PATENT DOCUMENTS

Figure 1:
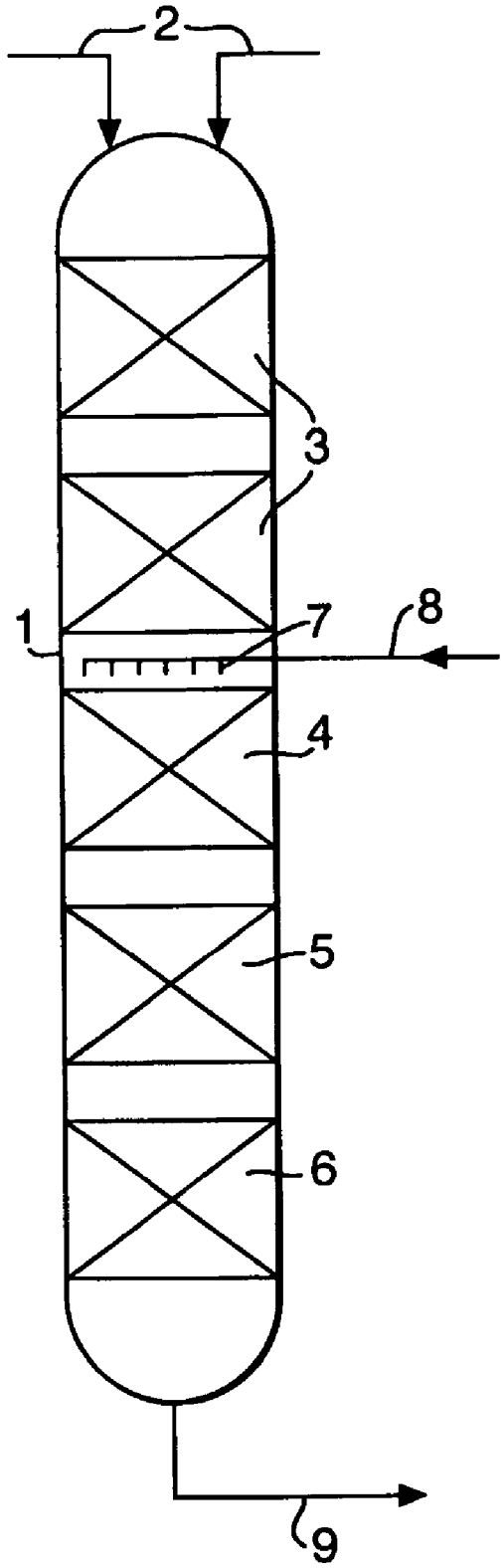

| | | | | |
|---|---|---|---|---|
| 5,252,527 | A | 10/1993 | Zones | 502/64 |
| 5,286,380 | A | 2/1994 | Mellen | 210/296 |
| 5,556,548 | A | 9/1996 | Mellen | 210/806 |
| 5,759,385 | A | 6/1998 | Aussillous et al. | 208/187 |
| 5,993,644 | A | 11/1999 | Xiao et al. | 208/89 |
| 6,007,787 | A | 12/1999 | Gupta et al. | 422/191 |
| 6,773,578 | B1 * | 8/2004 | O'Rear et al. | 208/28 |

FOREIGN PATENT DOCUMENTS

| | | |
|---|---|---|
| EP | 0329499 | 8/1989 |
| EP | 0448435 | 9/1991 |
| EP | 0564317 | 10/1993 |
| EP | 0574272 | 12/1993 |
| EP | 0832171 | 1/2000 |
| WO | 93/02793 | 2/1993 |
| WO | 94/25157 | 11/1994 |
| WO | 96/41849 | 12/1996 |
| WO | 97/18278 | 5/1997 |
| WO | 99/61566 | 12/1999 |
| WO | 00/29511 | 5/2000 |
| WO | 00/29512 | 5/2000 |

* cited by examiner

UPGRADING OF PRE-PROCESSED USED OILS

The invention is directed to a process to further upgrade a pre-processed used lubricating oil.

WO-A-9961566 describes a process to prepare a pre-processed used oil by removal of solids, low boiling compounds and polycyclic compounds from used oils.

The pre-processed used oils as obtained by such a process cannot be directly used as, lubricating base oil to formulate new lubricants. While some properties like the Viscosity Index (VI) generally do comply with industry standards for HVI (High VI) base oils (VI greater or equal to 95), other properties like pour point and Health/Safety/Environment (HSE) characteristics generally do not. It is an object of the present invention to provide a process to further upgrade the products as obtainable by the process of WO-A-9961566 or similar pre-processed used oils.

The following process achieves this object. Process to further upgrade a pre-processed used lubricating oil by:

(a) contacting the pre-processed used oil in the presence of hydrogen with a hydrodemetallization catalyst,
(b) contacting the effluent of step (a) in the presence of hydrogen with a hydrotreating catalyst, and
(c) contacting the effluent of step (b) in the presence of hydrogen with a dewaxing catalyst, and
(d) contacting the effluent of step (c) in the presence of hydrogen with a hydrotreating catalyst.

Applicants have found that with the above process excellent quality HVI (high viscosity index) base oils can be obtained from used oils having a sufficiently low pour point and excellent characteristics with respect to HSE aspects. The base oils as prepared by this process pass in particular the General Motors LS/2 suite of health tests (expressed in terms of Total PNAs (as measured by EPA SW-846), Residual elements (as measured by ASTM D5185), total PCB (as measured by EPA SW-846), total organic halogens and Modified Ames Test (as measured by ASTM E 1687) Further advantages of the process will become clear from the below description.

The pre-processed used oil can be prepared from various sources of used oils. The used oils are suitably subjected to an extraction treatment wherein most of the additive package resids, water and other insolubles are separated from the oil. The extraction is preferably performed with propane as the extraction solvent as for example described in U.S. Pat. No. 4,265,734, U.S. Pat. No. 5,286,380 and U.S. Pat. No. 5,556,548. Prior to the extraction process, zinc based additives and degradation products can be removed by precipitation as described in for example U.S. Pat. No. 4,376,040 and CA-A-2068905. The pre-processed oil may also be obtained from used oil by, for example, contacting the used oil with a basic substance and a phase transfer catalyst in the presence of water, contacting this mixture with liquid propane, separating the impurity-free oil from the propane and re-refining said impurity-free oil. Such a process is for example described in detail in the aforementioned WO-A-9961566.

Suitable pre-processed used oils have an oxygen content of less than 1 wt % and more preferably less than 0.5 wt % as calculated as the weight of oxygen atoms in the oil feed. The majority of this oxygen will be present as the bound oxygen of water molecules. Furthermore the pre-processed used oil suitably contains less than 2 wt % nitrogen and more preferably less than 0.05 wt % nitrogen. Furthermore the pre-processed used oil suitably contains less than 2 wt % sulphur and more preferably less than 1 wt % sulphur.

Typical pre-processed used oils will contain between 10-300 ppm chlorine. For the present process according to the invention the upper chlorine content is preferably less than 200 ppm and more preferably less than 150 ppm chlorine. The total content of phosphorus, calcium, zinc and silicon is typically between 20 and 1000 ppm and preferably between 20 and 300 ppm. Other (metal) compounds, such as iron, and sodium may also be present in low quantities.

The pour point of the pre-processed oil is preferably below 0° C. The viscosity index of the pre-processed oil is preferably above 90.

The pre-processed used oil, which is used as feedstock in the present process preferably has an initial boiling point of between 340 and 380° C. and more preferably about 370° C. The boiling point at which 95 vol % (T95) is recovered is preferably between 480 and 550° C. and more preferably between 500 and 540° C. It has been found that the pre-processed used oils having a higher T95 boiling point will contain a high level of compounds such as phosphorus, calcium, zinc and silicon. Such a high level of these compounds is detrimental for the catalyst life in the process according to the present process.

An example of the above described pre-processed oils is the Light Distillate as obtainable from the reclaiming process of Interline Resources Corporation as described in detail on their web page http://www.interline-resources.com/introduction.html as viewed on 1 Aug. 2000. The Light Neutral Distillate typically has an Initial Boiling Point (IBP) of more than 300° C. and preferably more than 340° C., a T50 (temperature at which 50 wt % of the distillate is recovered) in the range of between 430-470° C. and a Final Boiling Point (FBP) of below 600° C. The above feedstock may be blended with small portions of other hydrocarbon sources, such as for example the Heavy Neutral Distillate as obtained from the same Interline process. The heavy Neutral Distillate has typically an IBP of more than 300° C., a $T_{50}$ of between 500-520° C. and a FBP greater than 650° C.

Suitable hydrodemetallization catalysts to be used in step (a) are for example the hydrodemetallization (demet) catalysts developed to remove nickel, vanadium and molybdenum from crude oil residues. It has been found that such catalysts also reduce the content of halogens, such as chlorine and fluorine, but also phosphorus, calcium, zinc and silicon in a sufficient manner under hydro-processing conditions. Examples of such hydro-demetallization processes are described in U.S. Pat. No. 4,297,242 and U.S. Pat. No. 4,613,425. Such catalysts comprise suitably an alumina carrier, a Group VIB metal and optionally a non-noble Group VIII metal. Optionally phosphorus is deposited on the catalyst. A suitable Group VIB metal is molybdenum. Suitable non-noble Group VIII metals are nickel and cobalt. The alumina carrier is suitably more porous than the alumina support of the hydrotreating catalyst of steps (b) and (d).

In a preferred embodiment step (a) is performed using more than one type of hydrodemetallisation catalysts wherein the feed is first contacted with hydrodemetallisation catalysts having a high uptake capacity for metals and then contacted with hydrodemetallisation catalysts having a relatively higher desulphurisation and denitrification activity than the first type of catalyst or catalyst combination. Examples of suitable commercial hydrodemetallization catalysts are RM-430, RN-410 and RN-412 as obtained from Criterion Catalyst Company (Houston, US).

The catalyst used in step (a) is preferably presulfided before use (ex-situ and/or in-situ). Presulphiding of the catalyst can be achieved by methods known in the art, such as for instance those methods disclosed in the following publications EP-A-181254, EP-A-329499, EP-A-448435, EP-A-564317, WO-A-9302793 and WO-A-9425157.

Step (a) is suitably operated at a temperature of between 330 and 420° C. The pressure may range from 10 to 250 bar, but preferably is between 20 and 150 bar. The weight hourly space velocity (WHSV) may range from 0.1 to 10 kg of oil per liter of catalyst per hour (kg/l·h) and suitably is in the range from 2 to 10 and more preferably between 4 and 6 kg/l·h as calculated on the total of demet catalyst used in step (a).

In step (b) especially the level of nitrogen is reduced. The hydrotreating catalyst to be used in step (b) may therefore be any catalyst or catalyst combination known to one skilled in the art, which may catalyse such a reaction. Suitable catalysts comprise at least one Group VIB metal component and at least one non-noble Group VIII metal component selected from the group of iron, nickel or cobalt supported on a refractory oxide carrier. Examples of suitable Group IVB metals are molybdenum (Mo) and tungsten (W). Examples of suitable non-noble Group VIII metals are nickel (Ni) and cobalt (Co).

The refractory oxide support of the catalyst used in the first hydrotreating step may be any inorganic oxide, alumino-silicate or combination of these, optionally in combination with an inert binder material. Examples of suitable commercially available hydrotreating catalysts are C-424, DN190, DN200 and DN3100 of Criterion Catalyst Company (Houston, Tex.).

The catalyst used in step (b) is suitably at least partly sulphided prior to operation in order to increase its performance with time on stream. Presulphiding of the catalyst can be achieved by methods known in the art, such as for instance those methods disclosed in the earlier referred to publications relating to sulphided catalysts.

Step (b) is suitably operated at a temperature of between 250 and 420° C. and preferably between 350 and 400° C. The actual temperature will depend largely on the content of sulphur and/or nitrogen in the feed and the desired reduction to be achieved. Higher temperatures result in higher reduction of S- and N-content. The pressure may range from 10 to 250 bar, but preferably is between 20 and 150 bar. The weight hourly space velocity (WHSV) may range from 0.1 to 10 kg of oil per liter of catalyst per hour (kg/l·h) and suitably is in the range from 2 to 6 kg/l·h In step (c) the oil effluent of step (b) is contacted with a dewaxing catalyst. The pour point of the oil is lowered to a value of between −9 and −30° C. and more preferably to a value between −12 and −20° C. in step (c). This reduction can be achieved by for example adjusting the severity of the reaction and the choice of the catalyst.

The dewaxing catalyst may be any catalyst, which is known to reduce the pour point of a hydrocarbon feed in the presence of hydrogen. Suitable dewaxing catalysts are heterogeneous catalysts comprising a molecular sieve and optionally in combination with a metal functionality having a hydrogenation function. Suitable metals are Group VIII metals, for example nickel, cobalt, platinum and palladium. Combinations of platinum and palladium are also possible as well as combinations of nickel or cobalt with Group VIB metals, for example NiMo or NiW.

Molecular sieves, and more suitably intermediate pore size zeolites, have shown a good catalytic ability to reduce the pour point of a base oil precursor fraction under catalytic dewaxing conditions. Preferably the intermediate pore size zeolites have a pore diameter of between 0.35 and 0.8 nm. Suitable intermediate pore size zeolites are ferrierite, ZSM-5, ZSM-12, ZSM-22, ZSM-23, SSZ-32, ZSM-35 and ZSM-48. ZSM-5 may optionally be used in its HZSM-5 form in the absence of any Group VIII or VIB metals. The other molecular-sieves are preferably used in combination with the above listed metals. Further details and examples of suitable catalysts and dewaxing conditions are for example described in WO-A-9718278, U.S. Pat. No. 5,053,373, U.S. Pat. No. 5,252,527, U.S. Pat. No. 4,574,043, WO-A-0029511, WO-A-0029512 and EP-B-832171. Examples of suitable commercial for bare or base metal dewaxing catalysts are Z-706, SDD-800 (as obtainable from Criterion Catalyst Company), Hydex-L (from Sud Chemie), HC-80 (from UOP) and the Mobil MLDW catalyst. Examples of noble metal based catalysts are Z-876A (Criterion Catalyst Company), the Mobil MSDW catalyst, ICR-410 (from Chevron) and DW-10 (from UOP).

The effluent of step (b) may be directly used in step (c), for example when at least steps (a)-(c) are performed in one staked bed reactor comprising catalyst beds to perform the different steps. In such a series-flow type of operation the level of organic bound nitrogen in the effluent of step (b), which is used as feed to step (c), is preferably below 100 ppm and more preferably below 0.50 ppm. In the series flow embodiment the metal functionality of the dewaxing catalyst used in step (c) is preferably a non-noble metal from Group VIII, preferably nickel. The series flow embodiment is preferred because of its simplicity.

An alternative to the above series flow embodiment is an embodiment wherein hydrogen flow counter-current through a reactor in which steps (a)-(b) and optionally also steps (c) and optionally step (d) is performed. In this embodiment the metal functionality of the dewaxing catalyst is suitably a noble metal of or a combination of noble Group VIII metals, preferably platinum optionally in combination with palladium.

A next alternative to the series flow embodiment is a process wherein ammonia and hydrogen sulphide are removed from the effluent of step (b) prior to feeding this effluent to step (c). This removal can be suitably performed by stripping the effluent with hydrogen. In this embodiment the metal functionality of the dewaxing catalyst may be a noble metal of or a combination of Group VIII metals, preferably platinum and/or palladium. In this embodiment steps (c) and (d) are preferably performed in a counter current mode of operation. The conditions in step (c) are known in the art and typically involve operating temperatures in the range of from 300 to 450° C., suitably from 330 to 400° C., hydrogen pressures in the range of from 10 to 200 bar, preferably from 40 to 150 bar, weight hourly space velocities (WHSV) in the range of from 1 to 10 kg of oil per liter of catalyst per hour (kg/l/hr), suitably from 2 to 6 kg/l/hr and hydrogen to oil ratios in the range of from 100 to 2,000 liters of hydrogen per liter of oil.

In step (d) a final hydrotreating step is performed mainly to saturate any unsaturated compounds, reduce the level of colour bodies and stabilize the oil. The hydro-treating catalyst used in step (d) may be one of the catalysts or catalyst combinations as described for step (b). Especially when steps (a)-(d) are performed in the above explained series flow a non-noble catalyst is used in step (d). When the dewaxing catalyst of step (c) is based on a noble metal of Group VIII, the catalyst of step (d) is preferably also based on a noble metal. Noble metal based hydrotreating catalysts are suitably used at low hydrogen sulphide partial pressures. Thus higher hydrogen partial pressures will favour the use of such noble metal based hydrotreating catalysts. Such hydrotreating catalysts suitably comprise a noble metal component supported on an amorphous refractory oxide carrier. Suitable noble Group VIII metal components are platinum and palladium. Examples of such catalysts' are the commercially available C-622, C-624 and C-634 types of Criterion Catalyst Company (Houston, Tex.). These platinum/palladium catalysts are advantageous because they deactivate less when the sulphur content of the feed to step (d) is still relatively high.

Suitably the same catalyst or catalyst combinations are used in steps (b) and (d). Step (d) is suitably operated at a temperature of between 280 and 420° C. and preferably between 340 and 400° C. Higher temperatures result in higher reduction of the aromatic content in the hydrofinished product. The pressure may range from 10 to 250 bar, but preferably is between 20 and 150 bar. The weight hourly space velocity (WHSV) may range from 0.1 to 30 kg of oil per liter of catalyst per hour (kg/l·h) and suitably is in the range from 10 to 20 kg/l·h.

The catalyst used in the different steps (a)-(d) may be a single type catalyst or a combination or package of different catalyst having the same functionality.

In a preferred embodiment of the invention steps (a) to (d) are performed in one stacked-bed reactor as shown in FIG. 1. FIG. 1 shows a reactor (1) provided with a feed inlet (2) to supply the oil and hydrogen to one or more beds (3) of hydrodemetallization catalyst or hydro-demetallisation catalysts combination in which step (a) is performed. The reactor (1) is further provided with one or more beds (4) of a hydrotreating catalyst or hydrotreating catalysts combination in which step (b) is performed, one or more beds (5) of a dewaxing catalyst in which step (c) is performed and one or more beds (6) in which step (d) is performed. Because step (a) is suitably performed at a higher temperature, suitably between 10 and 40° C. higher temperature, than step (b) a gas quench (7) is present, wherein via (8) an hydrogen-rich stream can be supplied to the reaction mixture flowing through the reactor. The reactor is further provided with an outlet (9) for the final base oil product. The embodiment of FIG. 1 shows a process series flow configuration wherein hydrogen and the oil feed flow co-current.

The invention will be illustrated with the following non-limiting examples.

EXAMPLE 1

A pre-processed used oil as obtained from the Interline reclaiming process was used as feed for this Example. The relevant properties of this feed are listed in Table 1.

TABLE 1

| Feed | | | |
|---|---|---|---|
| Sulphur (ppm) | 5600 | Kinematic viscosity at 100° C. | 6.7 cSt |
| Nitrogen (ppm) | 228 | Viscosity Index | 105 |
| Total metals (ppmw) | 97 | Pour Point | −7° C. |
| Phosphor (ppmw) | 31 | Boiling range: IBP | 355° C. |
| Calcium (ppmw) | 32 | 50 vol % | 450° C. |
| Zinc (ppmw) | 10 | 95 vol % | 535° C. |
| Silicon (ppmw) | 10 | | |
| Chlorine (ppmw) | 50 | | |

The feed of Table 1 was fed to a stacked bed reactor as shown in FIG. 1. The upper catalyst bed consisted of Criterion hydrodemetallisation catalyst RM-430, the second bed of Criterion hydrodemetallisation catalyst RN-410, the third bed of Criterion hydrotreating catalyst C-424, the fourth bed of commercial SDD-800 dewaxing catalyst and the fifth catalyst bed was again a Criterion C-424 hydrotreating catalyst. The operating pressure was 51.6 bar and the gas rate was 500 Nl/kg of feed. Further process conditions as in Table 2.

TABLE 2

| Step | A1 | A2 | B | C | D |
|---|---|---|---|---|---|
| Catalyst | RM-430 | RN-410 | C-424 | SDD-800 | C-424 |
| Temperature (° C.) | 380 | 380 | 365 | 365 | 365 |
| WHSV (kg/l/hr) | 12 | 12 | 4 | 4 | 15 |

The effluent of step (d) was distilled into 3 fractions: a fraction having a kinematic viscosity at 100° C. of 4.7 cSt, a fraction having a kinematic viscosity at 100° C. of 9.35 cSt and a fraction boiling below 370° C. The product fractions were analysed and the properties are listed in Table 3.

TABLE 3

| | Product fraction 1 | Product fraction 2 |
|---|---|---|
| Kinematic viscosity at 100° C. (cSt) | 4.7 | 9.35 |
| VI | 96 | 102 |
| Pour point (° C.) | −20 | −11 |
| Sulphur content mg/kg | 259 | 535 |
| Saturates content (wt % according to ASTM 2007) | 77 | 73 |
| Metals content (ppmw) | <1 | <1 |
| Chlorine content (ppmw) | not detectable below detection limit | not detectable below detection limit |

The results listed in Table 3 show that starting from a pre-processed oil API Group I base oils having an improved pour point, close-to-zero metal and chlorine content and reduced content in sulphur and nitrogen is obtained in a high yield (97 wt % on 375° C.+ in feed) on feed while the viscosity index of each fraction is hardly affected. Another observation is that the results have been obtained using the simple series flow embodiment as shown in FIG. 1. Thus a simple hydroprocessing method is provided to upgrade a pre-processed used oil to a base oil having properties comparable to those of virgin base oil.

EXAMPLE 2

Example 1 was repeated but at a process pressure of 121 bar and a gas recycle rate of 1000 Nl/kg of feed. The base oil obtained as effluent of step (d) had the properties as listed in Table 4. In this case API group II Base Oils have been obtained.

TABLE 4

| | Product fraction 1 | Product fraction 2 |
|---|---|---|
| Kinematic viscosity at 100° C. (cSt) | 4.4 | 8.6 |
| VI | 105 | 109 |
| Pour point (° C.) | −11 | −7 |
| Sulphur content mg/kg | 9 | 20 |

TABLE 4-continued

| | Product fraction 1 | Product fraction 2 |
|---|---|---|
| Saturates content | 93 | 91 |
| Metals content (ppmw) | <1 | <1 |
| Chlorine content (ppmw) | not detectable | not detectable |

We claim:

1. A process for making a base oil product from a used lubricating oil by preparing a pre-processed used oil by removing solids, low boiling compounds and polycyclic compounds from the used lubricating oil, and, further by:

(a) contacting the pre-processed used oil in the presence of hydrogen with a hydrodemetallization catalyst;

(b) contacting the effluent of step (a) in the presence of hydrogen with a hydrotreating catalyst;

(c) contacting the effluent of step (b) in the presence of hydrogen with a dewaxing catalyst;

(d) contacting the effluent of step (c) in the presence of hydrogen with a second hydrotreating catalyst and yielding from step (d) the base oil product.

2. The process of claim 1, wherein the pre-processed oil has an oxygen content of less than 1 wt %, a sulphur content of less than 2 wt % and a chlorine content of between 10-300 ppm.

3. The process of claim 2, wherein the pre-processed oil has an initial boiling point of between 340 and 380°C.

4. The process of claim 3, wherein the hydrodemetallization catalyst includes a first catalyst and a second catalyst, wherein the first catalyst has a higher metal uptake capacity than the second catalyst and the second catalyst has a higher hydrodenitrogenation and hydrodesulphurisation performance than the first catalyst.

5. The process of claim 4, wherein steps (a) to (d) are performed in series flow, such that gas and liquid flow co-current when contacted with the catalysts, and wherein the reduction of organic bound nitrogen in steps (a) and (b) is such that the nitrogen content in the effluent to step (c), is below 100 ppm.

6. The process of claim 5, wherein the nitrogen content in the effluent to step (c) is below 50 ppm.

7. The process of claim 6, wherein the dewaxing catalyst used in step (c) comprises an intermediate pore size zeolite having a pore diameter of between 0.35 and 0.8 nm and a non-noble Group VIII metal.

8. The process-of claim 7, wherein the catalyst used in step (b) and (d) are the same catalyst comprising a Group VIB metal, a non-noble Group VIII metal and a refractory oxide support.

9. The process of claim 8, wherein the process is performed in one reactor comprising a number of stacked beds of catalysts to perform steps (a) to (d).

10. The process of claim 4, wherein at least steps (a) to (b) are performed in a reactor comprising a number of stacked beds of catalysts to perform steps (a) and (b) and wherein gas and liquid flow counter-current when contacting the catalyst.

11. The process of claim 4, wherein hydrogen sulphide and ammonia are removed from the effluent of step (b) before performing step (c).

12. The process of claim 11, wherein the dewaxing catalyst used in step (c) comprises an intermediate pore size zeolite having a pore diameter of between 0.35 and 0.8 nm and a noble Group VIII metal.

13. The process of claim 12, wherein the catalyst used in step (d) comprises a noble Group VIII metal and a refractory oxide support.

14. The process of claim 1, wherein the pre-processed oil has an initial boiling point of between 340 and 380°C.

15. The process of claim 1, wherein step (a) is performed by first contacting the oil with two different types of a hydrode-metallisation catalyst, wherein the first has a higher metal uptake capacity than the second catalyst and the second catalyst has a higher hydrodenitrogenation and hydrodesulphurisation performance than the first catalyst.

16. The process of claim 2, wherein step (a) is performed by first contacting the oil with two different types of a hydrode-metallisation catalyst, wherein the first has a higher metal uptake capacity than the second catalyst and the second catalyst has a higher hydrodenitrogenation and hydrodesulphurisation performance than the first catalyst.

17. The process of claim 1, wherein steps (a) to (d) are performed in series flow, such that gas and liquid flow co-current when contacted with the catalysts, and wherein the reduction of organic bound nitrogen in steps (a) and (b) is such that the nitrogen content in the effluent to step (c), is below 100 ppm.

18. The process of claim 2, wherein steps (a) to (d) are performed in series flow, such that gas and liquid flow co-current when contacted with the catalysts, and wherein the reduction of organic bound nitrogen in steps (a) and (b) is such that the nitrogen content in the effluent to step (c), is below 100 ppm.

19. The process of claim 3, wherein steps (a) to (d) are performed in series flow, such that gas and liquid flow co-current when contacted with the catalysts, and wherein the reduction of organic bound nitrogen in steps (a) and (b) is such that the nitrogen content in the effluent to step (c), is below 100 ppm.

20. The process of claim 5, wherein the dewaxing catalyst used in step (c) comprises an intermediate pore size zeolite having a pore diameter of between 0.35 and 0.8 nm and a non-noble Group VIII metal.

21. The process of claim 5, wherein the catalyst used in step (b) and (d) are the same catalyst comprising a Group VIB metal, a non-noble Group VIII metal and a refractory oxide support.

22. The process of claim 6, wherein the catalyst used in step (b) and (d) are the same catalyst comprising a Group VIB metal, a non-noble Group VIII metal and a refractory oxide support.

23. The process of claim 5, wherein the process is performed in one reactor comprising a number of stacked beds of catalysts to perform steps (a) to (d).

24. The process of claim 6, wherein the process is performed in one reactor comprising a number of stacked beds of catalysts to perform steps (a) to (d).

25. The process of claim 7, wherein the process is performed in one reactor comprising a number of stacked beds of catalysts to perform steps (a) to (d).

26. The process of claim 1, wherein at least steps (a) to (b) are performed in a reactor comprising a number of stacked beds of catalysts to perform steps (a) and (b) and wherein gas and liquid flow counter-current when contacting the catalyst.

27. The process of claim 2, wherein at least steps (a) to (b) are performed in a reactor comprising a number of stacked beds of catalysts to perform steps (a) and (b) and wherein gas and liquid flow counter-current when contacting the catalyst.

28. The process of claim 3, wherein at least steps (a) to (b) are performed in a reactor comprising a number of stacked beds of catalysts to perform steps (a) and (b) and wherein gas and liquid flow counter-current when contacting the catalyst.

29. The process of claim-10, wherein the dewaxing catalyst used in step (c) comprises an intermediate pore size zeolite having a pore diameter of between 0.35 and 0.8 nm and a noble Group VIII metal.

30. The process of claim 10, wherein the catalyst used in step (d) comprises a noble Group VIII metal and a refractory oxide support.

31. The process of claim 1, wherein hydrogen sulphide and ammonia are removed from the effluent of step (b) before performing step (c).

32. The process of claim 2, wherein hydrogen sulphide and ammonia are removed from the effluent of step (b) before performing step (c).

33. The process of claim 3, wherein hydrogen sulphide and ammonia are removed from the effluent of step (b) before performing step (c).

34. A process for making a base oil product from a used lubricating oil, wherein said process comprises:

processing a used lubricating oil to remove solids, low boiling compounds and polycyclic compounds from said used lubricating oil to thereby provide a pre-processed used oil;

contacting said pre-processed used oil with a hydrodemetallization catalyst for use in removing metals from said pre-processed used oil under hydrodemetalization conditions and yielding a demetalized effluent;

contacting said demetalized effluent with a hydrotreating catalyst for use in reducing the level of nitrogen in said demetalized effluent under hydrotreating conditions and yielding a denitrogenated effluent;

contacting said denitrogenated effluent with a dewaxing catalyst for use in reducing the pour point of said denitrogenated effluent under dewaxing conditions and yielding a dewaxed effluent; and contacting said dewaxed effluent with a second hydrotreating catalyst for use in hydrofinishing said dewaxed effluent under hydrofinisihing conditions and yielding said base oil product.

35. A process as recited in claim 34, wherein said pre-processed used oil has an oxygen content of less than 1 wt %, a sulfur content of less than 2 wt %, a chlorine content in the range of from 10 to 330 ppm, and an initial boiling point in the range of from 340°C. to 380°C.

36. A process as recited in claim 35, wherein said hydrodemetallization catalyst, said hydrotreating catalyst, said dewaxing catalyst, and said second hydrotreating catalyst are each respectively contained in a hydrodemetallization catalyst bed, a hydrotreating catalyst bed, a dewaxing catalyst bed and a second hydrotreating catalyst bed that are arranged in a stacked bed arrangement within a single reactor vessel, wherein said stacked bed arrangement is operated in a series flow operation.

37. A process as recited in claim 36, wherein said hydrodemetallization catalyst comprises an alumina carrier, a Group VIB metal and a non-noble Group VIII metal, and wherein said hydrotreating catalyst comprises at least one Group VIB metal component and at least one non-noble Group VIII metal component selected from the group consisting of iron, nickel or cobalt supported on a refractory oxide carrier, and wherein said dewaxing catalyst comprises a molecular sieve and a Group VIII metal selected from the group consisting of nickel, cobalt, platinum and palladium, and wherein said second hydrotreating catalyst comprises a refractory oxide support, at least one Group VIB metal and at least one Group VIII component selected from the group consisting of iron, nickel and cobalt.

38. A process as recited in claim 36, wherein said hydrodematallization catalyst bed comprises a first hydrometallization catalyst bed containing a high metals uptake capacity hydrodemetallization catalyst and a second hydrodemetallization catalyst bed containing a high hydrodesulfurization and denitrification activity hydrodemetallization catalyst, wherein said high metals uptake capacity hydrodemetallization catalyst has a higher metal uptake capacity than that of said high hydrodesulfurization and denitrification activity hydrodemetallization catalyst, and wherein said said high hydrodesulfurization and denitrification activity hydrodemetallization catalyst has a higher hydrodesulfurization and denitrification activity than that of said high metals uptake capacity hydrodemetallization catalyst.

39. A process as recited in claim 38, wherein said denitrogenated effluent comprises a nitrogen content that is below 100 ppm.

40. A process as recited in claim 39, wherein said molecular sieve of said dewaxing catalyst includes an intermediate pore size zeolite having a pore diameter between 0.35 and 0.8 nm.

41. A process as recited in claim 40, further comprising:

combining a quench gas with said demetallized effluent that is contacted with said hydrotreating catalyst.

* * * * *